United States Patent [19]

Miyamoto et al.

[11] 3,957,573

[45] May 18, 1976

[54] PROCESS FOR PRODUCING INSULATING PAPER WHERE THE PAPER IS FRICTIONALLY CALENDERED

[75] Inventors: Haruo Miyamoto, Nagoya; Ikuo Igami, Tomei; Masaru Uehara, Nagoya; Hideo Fujita, Takarazuka; Hirotaka Itoh, Nishinomiya; Zyozi Kan, Niihama, all of Japan

[73] Assignees: Dainichi-Nippon Cables, Ltd., Amagasaki; Mitsubishi Rayon Co., Ltd., Tokyo, both of Japan

[22] Filed: Nov. 8, 1972

[21] Appl. No.: 304,882

[30] Foreign Application Priority Data

Nov. 9, 1971 Japan ..... 46-89606

[52] U.S. Cl. ..... 162/102; 100/38; 162/138; 162/146; 162/157 R; 162/168 R; 162/206; 264/121

[51] Int. Cl.[2] ..... D21H 5/20; D21H 5/26

[58] Field of Search ..... 162/157 R, 146, 197, 162/206, 205, 138, 102, 168; 264/210, 121, 210 R, 210 F; 174/25; 100/38

[56] References Cited

UNITED STATES PATENTS

| | | | |
|---|---|---|---|
| 2,971,858 | 2/1961 | diGiulio et al. | 162/138 X |
| 3,000,778 | 9/1961 | Sively | 162/205 |
| 3,049,466 | 8/1962 | Erlich | 162/206 X |
| 3,097,991 | 7/1963 | Miller et al. | 162/157 R |
| 3,104,197 | 9/1963 | Back et al. | 162/206 X |
| 3,401,078 | 9/1968 | Grossteinbeck et al. | 162/157 R X |
| 3,477,906 | 11/1969 | Rabstad | 162/205 |
| 3,532,800 | 10/1970 | Wyly et al. | 162/146 X |
| 3,533,902 | 10/1970 | Hoch | 162/206 |
| 3,582,418 | 6/1971 | Schuur | 156/83 |
| 3,619,460 | 11/1971 | Chill | 264/210 R X |
| 3,669,829 | 6/1972 | Caldo et al. | 162/157 R |
| 3,674,621 | 7/1972 | Miyamoto et al. | 162/157 R X |
| 3,814,622 | 6/1974 | Issliki et al. | 117/138.8 E |

*Primary Examiner*—S. Leon Bashore
*Assistant Examiner*—William F. Smith
*Attorney, Agent, or Firm*—Sughrue, Rothwell, Mion, Zinn & Macpeak

[57] ABSTRACT

Polyolefin fibers containing at least 70% by weight of polypropylene fibers having a denier of at least 0.5 and a birefringence of at least $2.5 \times 10^{-2}$ are formed into a sheet. The sheet is then frictionally calendered in the dry state at a frictional ratio of at least 15% and at a temperature in the range from 90°C to 160°C whereby an insulating paper having excellent air-impermeability and oil-resistance is obtained.

29 Claims, 1 Drawing Figure

PROCESS FOR PRODUCING INSULATING PAPER WHERE THE PAPER IS FRICTIONALLY CALENDERED

BACKGROUND OF THE INVENTION

1. Field of the Invention

This invention relates to a process for producing an insulating paper and, more particularly, it relates to a process for producing a polypropylene insulating paper having a high air-impermeability and excellent oil-resistance.

2. Description of the Prior Art

Heretofore, insulating papers useful in oil-filled electric devices and machinery, such as oil-filled cables and oil-filled condensers, have often been produced from polypropylene because of the low dielectric loss and low price of the polypropylene. Processes for producing such papers are disclosed, for example, in U.S. Pat. Nos. 3,532,800, 3,650,866, etc. However, the polypropylene paper produced in accordance with the process disclosed in U.S. Pat. No. 3,532,800 is made of a fiber mixture containing at least 50% by weight of microfibers having a diameter less than 10 microns and exhibits poor oil-resistance, and the polypropylene paper disclosed in U.S. Pat. No. 3,650,866 is constructed with fibers fabricated by the blowing method having a diameter of at least 0.5 denier and exhibits an unsatisfactory oil-resistance and air-permeability.

SUMMARY OF THE INVENTION

This invention provides a process for producing a polypropylene insulating paper comprising forming a sheet out of polyolefin fibers containing at least 70% by weight of polypropylene fibers having a denier of at least 0.5 and a birefringence of at least $2.5 \times 10^{-2}$, and frictionally calendering the sheet at a frictional ratio of at least 15% and at a temperature in the range from 90° to 160°C.

The primary object of this invention is therefore to provide a process for producing a polypropylene paper suitable for use as an insulating paper.

Another object of this invention is to provide a process for producing an insulating paper having improved air-impermeability, oil-resistance and mechanical strength.

BRIEF DESCRIPTION OF THE ACCOMPANYING DRAWING

The drawing is a plot of air-impermeability of different paper versus the frictional ratio to which the paper has been subjected during calendering.

DETAILED DESCRIPTION OF THE INVENTION

Figure 1:
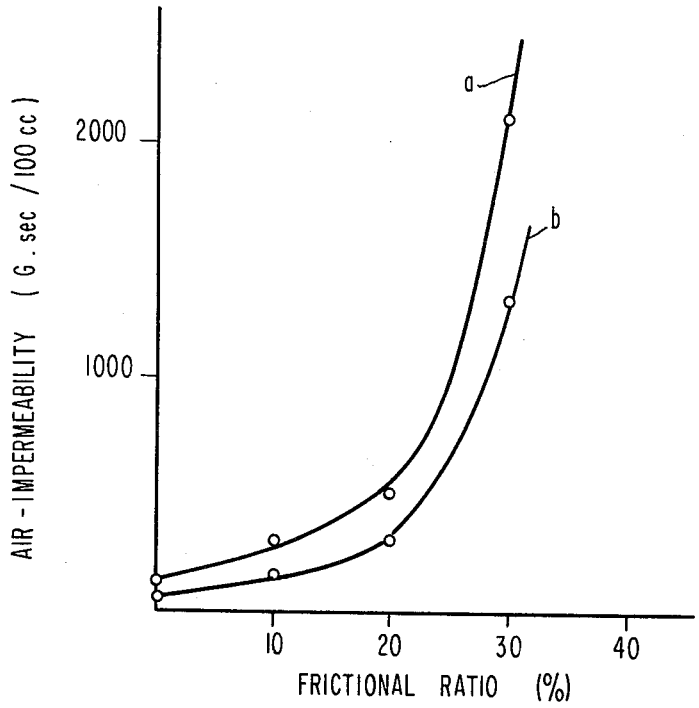

Within the broad bounds of the present invention as described above several preferred embodiments exist. While in all embodiments the fiber sheet comprises at least 70% polypropylene having a denier of at least 0.5 and a birefringence of at least $2.5 \times 10^{-2}$, in one preferred embodiment a sheet composed of a fiber mixture of such polypropylene fibers with fibers of a different polypropylene, polyethylene or a mixture of such a different polypropylene and polyethylene is frictionally calendered. In a second preferred embodiment polypropylene fibers having a denier of at least 0.5 and a birefringence of at least $2.5 \times 10^{-2}$ are sheeted in the form of a bicomponent fiber with polyethylene, e.g., such polypropylene is simultaneously extruded with separately melted polyethylene to give a two-component fiber formed of a polypropylene fiber joined to a polyethylene fiber, or a fiber formed of such polypropylene is coated with polyethylene. In a third embodiment, a sheet composed of a mixture of polypropylene fibers having a denier of at least 0.5 and a birefringence of at least $2.5 \times 10^{-2}$ with bicomponent fibers as described are subjected to frictional calendering.

In any embodiment, a polypropylene insulating paper with useful air-impermeability, oil-resistance and mechanical strength is obtained by frictional calendering at a temperature of from 90°C to 160°C and at a frictional ratio of at least 15%. However, in those embodiments where significant proportions of polyethylene are present, superior results are obtained at less severe calendering conditions within the above range, i.e., close to the 90°C - 15% lower bound, while to obtain optimum results with fiber systems containing less than about 5% polyethylene, one preferably frictionally calenders at a temperature of at least 115°C and at a frictional ratio of at least 20%.

In those embodiments where less severe conditions provide more preferred results, from about 5 to 30% by weight polyethylene is present, more preferably from 10 to 20%, by weight.

In the present invention polypropylene fibers having a denier of at least 0.5 and a birefringence of at least $2.5 \times 10^{-2}$, preferably at least $3.0 \times 10^{-2}$, are employed to form a polypropylene paper.

The polypropylene fiber generally has a denier less than about 30, more preferably less than 15, and a birefringence less than about $5.0 \times 10^{-2}$, more preferably less than $4.5 \times 10^{-2}$.

Such polypropylene fibers have been found to have excellent oil-resistance, and they can be fabricated, for example, by drawing a polypropylene fiber produced by any well-known melt-spinning or film splitting process, to a draw ratio of 300% – 900% at a temperature ranging from 130° to 160°C. The birefringence of the polypropylene fiber can be determined by the retardation method using a polarizing microscope equipped with a Berek compensater, or may be determined by the Becke method. See *Physical Properties of High Molecular Weight Compounds* in Experimental Lecture on High Molecular Weight Compounds, Vol. 4, published by Kyoritsu Shuppan, Tokyo, 1959, pp 77 – 109.

Preferable polypropylenes as a raw material for producing the polypropylene fibers used in this invention are those having an intrinsic viscosity of from about 1.0 to about 3.0 (as determined at 135°C in decalin using an Ubbelohde viscometer).

In particular, polypropylenes fiber having excellent oil-resistance and mechanical strength can be obtained from a polypropylene having an intrinsic viscosity in the range of from 1.4 to 2.0 and a density greater than 0.89.

In the present invention polypropylene fibers are firstly formed into sheets. The polypropylene sheet may be formed by any conventional procedure, for example, by using conventional machinery for the fabrication of dry non-woven fabrics such as a garnet machine or a random webber, or by a wet paper-making method using a binder, or by a dry paper-making method using a random sheeter and the like. However, a wet paper-making process which generally comprises cutting the polypropylene fibers into a cut length of from 0.5 to 20 mm, preferably from 3 to 15 mm, and dispersing such short cut fibers in a dispersing medium such as water or an organic solvent as hereinafter described is particularly preferred since the process provides a sheet having a uniform air-impermeability. The term "short cut" fibers used herein refers to the fibers having a cut length of from 0.5 to 20 mm, preferably from 3 to 15 mm.

When water is used as a dispersing medium in the wet paper-making process, short cut polypropylene fibers are dispersed together with a binder in water, and the resulting dispersion is subjected to a paper-making process to obtain a sheet wherein the fibers are temporarilly adhered together by the binder. The sheet is then heated at a temperature greater than the shrinkage temperature of the polypropylene fiber (generally about 130°C) but lower than the melting point of the polypropylene fiber to give a sheet having a high wet strength due to the entangling of the fibers during shrinkage. The sheet is subsequently washed with water to remove binder remaining in the sheet. As the binder used the so-called "wet-heat melting types" are preferred.

Such binders are substantially insoluble in cold water but are soluble in warm or hot water and exhibit an adhesive effect in the dissolved state.

Examples of useful wet-heat melting type binders are polyethylene oxide, saponified compounds of polyvinyl acetate or copolymers which are primarily composed of vinyl acetate monomer units, and the acetals of the saponified compounds. Saponified compounds having high solubility in water or hot water are preferred. The binders should be highly soluble in water at a temperature of from about 40° to about 100°C, preferably from about 40° to 70°C. These wet-heat melting type binders can easily be removed from the sheet by washing the heat-treated sheet with warm or hot water, so that a sheet having an excellent dielectric property is obtained. These wet-heat melting type binders are generally added to the fiber to be subjected to the paper-making process in the form of a powder or a fiber in an amount of from about 10 to about 30 parts by weight of binder per 100 parts by weight of the polypropylene fiber.

The exact binder used is not overly critical, and any of those presently used by the art in similar systems can generally be used with success.

When an organic solvent is used as a dispersing medium in the wet paper-making process, short cut polypropylene fibers are dispersed in an organic solvent in which the polypropylene is not dissolved at room temperature but in which the polypropylene is soluble at high temperature, for example, tetralin, decalin, xylene, methylene chloride and the like, or mixtures thereof, and the resulting dispersion is subjected to the paper-making process. The wet web thus obtained is then heated to partially dissolve the polypropylene fiber in the solvent remaining in the web, to melt the fibers sufficiently to adhere them to each other to provide excellent mechanical strength to the sheet.

When the polypropylene fiber is heated at a temperature greater than the shrinkage temperature of the polypropylene fiber (usually about 130°C) but less than the melting point of the polypropylene, the temperature at which the polypropylene dissolves in the above organic solvent rises to some extent. A sheet having excellent mechanical strength can be obtained from a mixture of such heat-treated polypropylene fibers and untreated polypropylene fibers by subjecting the mixture to a wet papermaking process as heretofore described and then heating the resulting wet web at a temperature at which the previously heat-treated fiber does not dissolve but the untreated fiber dissolves sufficiently to adhere to the treated fiber.

In the process of this invention, the sheet obtained in the above manner is dried, and then subjected to a frictional calendering. The polypropylene fiber sheet is passed between a pair of rolls, each of which rotates at a peripheral speed different from the other, i.e., friction calender rolls. Such a frictional calendering is carried out at a frictional ratio of 15%, or more, and at a sheet temperature in the range of from 90°C to 160°C, more preferably, at a frictional ratio of 20%, or more, and a sheet temperature in the range of from 115° to 160°C, whereby the sheet undergoes a shearing force due to the difference of the peripheral speed of the rolls. Generally, a frictional ratio of less than about 300% is used with good results, more preferably less than about 100%. The polypropylene fibers in the sheet, in particular the fibers located at the surface of the sheet, are deformed and partially fill the interspace among the fibers in the sheet, thereby increasing the air-impermeability of the sheet. In order to obtain a paper having a higher air-impermeability from a sheet of the above described polypropylene fibers by the frictional calendering described above, the sheet preferably has a basis weight in the range of from 20 to 400 g/m$^2$.

The term frictional ratio as used herein denotes the value calculated by the following equation:

$$\text{Frictional Ratio } (\%) = (r_2 - r_1)/r_1 \times 100$$

wherein:

$r_1$ is the peripheral speed of the roll rotating at the lower peripheral speed (m/minute).

$r_2$ is the peripheral speed of the roll rotating at the higher peripheral speed (m/minute).

Conventional calender rolls composed of an elastic roll and a steel roll may suitably be used in the present invention as the frictional calender rolls.

The only requirement for the calendering rolls is that at least one roll gives a friction sufficient to yield the recited frictional ratio to the sheet to be calendered. Examples of suitable elastic rolls include a paper roll, a rubber roll, etc.

The heating of the sheet during frictional calendering at the temperature described above can be accomplished by any well-known procedure. For example, heat can be supplied to the sheet from the steel calender roll held at a high temperature or the sheet can be previously heated in any suitable manner and the thus heated sheet fed to the frictional calender rolls. When the sheet is subjected to the friction calendering at a frictional ratio more than 100%, the sheet is usually sufficiently heated by frictional heat so that it is not necessary to supply external heat.

When the temperature of the sheet is lower than 90°C during frictional calendering, a high air-impermeability cannot be obtained because of insufficient deformation of the fibers by the frictional calendering. On the other hand, when the temperature of the sheet exceeds 160°C, the sheet often becomes a molten film, whereby oil-impregnation is accomplished only with difficulty, which renders the material unfavorable for use in an insulating layer. Further, when the frictional ratio is lower than 15%, an improvement in air-impermeability is not effectively attained even if the sheet temperature is in the controlled range described above. Particularly, improved air-impermeability is obtained at a frictional ratio greater than 20%, and especially at frictional ratios greater than 25%.

In the Drawing, curve A shows the experimental relationship between the air-impermeability and the frictional ratio with respect to a polypropylene paper produced through the wet-paper making process, when the paper is calendered at different frictional ratios at 150°C, while curve B shows such a relationship for a non-woven polypropylene fabric produced through the spunbond process, when the fabric is calendered at 155°C.

It is to be noted that in either case the air-impermeability is sharply increased with the frictional ratio is more than 20%, in particular, more than 25%. [Air-impermeability was determined in accordance with the criteria described in JIS P8117 in terms of Gurley's impermeability (sec/100cc of air)].

In the present invention, frictional calendering is usually carried out with a high roll pressure preferably, under a pressure ranging from about 20 to about 300 Kg/cm in terms of nip-pressure.

In another embodiment of the present invention, polyethylene fibers, preferably, polyethylene fibers having a density of from 0.955 to 0.97 or polypropylene microfibers having an average fiber diameter of from $2\mu$ to $10\mu$ produced from polypropylene whose extractable content in decalin at 77°C is less than 15% by weight may be incorporated into the above-mentioned polypropylene having a denier of at least 0.5 and a birefringence of at least $2.5 \times 10^{-2}$. Such fibers are incorporated in an amount of less than 30% by weight based on the total weight of the fibers.

The polyethylene fibers or polypropylene microfibers incorporated effectively fill up the interspace between the polypropylene fibers in the course of frictional calendering. Therefore, the air-impermeability and the mechanical strength of a sheet thus formed are further improved.

The oil-resistance of the resulting paper is not significantly decreased in this case by the incorporation of these fibers, if the amount of these fibers incorporated is in the range recited above, i.e., less than 30% by weight based on the total weight of the fibers. Needless to say, mixtures of such incorporated fibers may also be used so long as the 30% criterion is followed.

The polyethylene fibers or the fine polypropylene fibers are uniformly incorporated into the polypropylene fiber having a denier of at least 0.5 and the resulting mixed fiber is subjected to the sheet-making process and the succeedingly calendering in the same manner as previously described. When polyethylene fiber as described above is incorporated into polypropylene fiber having a denier of at least 0.5 a paper having a satisfactory air-impermeability can be obtained under rather mild frictional calendering conditions. At a frictional ratio greater than 15% and at a temperature in the range of from 90° to 160°C, a sheet having a satisfactory property can be obtained. However, sheets having more preferred properties can generally be obtained at a frictional ratio greater than 20%, desirably greater than 25%, and at a temperature in the range of from 115°C to 160°C.

As previously described, polypropylene microfiber can be incorporated as an additive in an amount less than 30% by weight. The preferred amount of the polypropylene microfiber has been found to be in the range of from 10 to 15% by weight. Such microfiber is produced from a polypropylene whose extractable content in decalin at 77°C is less than 15% by weight by any well-known procedure, for example, by dissolving the polypropylene in a low boiling solvent such as methylene chloride, heating the resulting solution in a tank having nozzles, ejecting the resulting solution from the tank through the nozzles by the vapor pressure of the materials in the tank spinning the melted polypropylene through nozzles by centrifugal force.

The term "decalin extractable content" used herein means the value determined by immersing a 5 g sample of finely powdered polypropylene (approximately 100 mesh) into an appropriate volume of decalin at a temperature of 77°C while stirring for 3 hours, and determining the percentage of the material extracted based on the weight of polypropylene before immersion.

Polypropylene having a decalin extractable content less than 15% at 77°C may easily be prepared, for example, by successively washing a polypropylene produced by any conventional process with methanol, acetone, and then with n-heptane or n-hexane. In the present invention a preferred polypropylene used as a raw material for the microfibers above-mentioned is one having an intrinsic viscosity of from 1.0 to 3.0 and a decalin extractable content less than 15% more preferably one having a decalin extractable content less than 5% and an intrinsic viscosity of from 1.4 to 2.0 from the standpoint of oil-resistance.

In the present invention the polyethylene fiber described above preferably has a denier of at least 0.5 and is preferably incorporated into the polypropylene fiber having a denier of at least 0.5 and a birefringence of at least $2.5 \times 10^{-2}$ in an amount of from 2 to 30%, more preferably from 5 to 20%, by weight.

In addition to the incorporation of the polyethylene fiber into the polypropylene fiber as described above, the polyethylene may also be incorporated into the polypropylene fiber in the form of a bicomponent fiber with the above polypropylene fiber. Such a bicomponent fiber can be obtained by a composite spinning process in which separately melted polypropylene and polyethylene are extruded through one nozzle or can be obtained by coating a polypropylene fiber with polyethylene. A preferred coating process comprises dissolving polyethylene in a solvent such as perchloroethylene, benzene, carbon tetrachloride, gasoline, etc. and spraying the resulting solution on the polypropylene fibers. The bicomponent fibers can be prepared by the method disclosed in U.S. Pat. No. 2,987,797, as well as by modifications of methods as disclosed in the above U.S. patent. Other equivalent methods of forming bicomponent fibers will be obvious to one skilled in the art. In order to increase the birefringence of the polypropylene fiber portion of the bicomponent fiber produced as above to $2.5 \times 10^{-2}$ or more, the drawing treatment previously described for the polypropylene fiber can also be applied to the bicomponent fiber. In this invention the sheet can be formed with the bicomponent fiber alone or can be used as mixture with polypropylene fiber having a denier of at least 0.5 and a birefringence of at least $2.5 \times 10^{-2}$.

In the present invention, it is preferred to purify the fiber sheet before and/or after subjecting the sheet to frictional calendering, since most of the sheets contain impurities such as spinning oils or ionic materials.

These impurities can be substantially completely removed from the sheet by washing the sheet with water, preferably water held at a temperature of at least 40°C, or with a hydrophilic solvent, a lipophilic solvent or with a mixed solvent comprising a hydrophilic solvent and a lipophilic solvent. The most economical and effective procedure for removing impurities comprises firstly washing the sheet with water such as industrial water or tap water, secondly with deionized water, and finally with a mixed solvent of a hydrophilic solvent and a lipophilic solvent.

Examples of preferred hydrophilic solvents are alcohols and ketones having less than 6 carbon atoms, preferably having 1 to 4 carbon atoms such as methanol, ethanol, n-propanol, iso-propanol, n-butanol, isobutanols, amyl alcohol, and the like and acetone, methylacetone, methylethylketone, methylpropylketone, diethylketone, methylbutylketone, methylisobutylketone, ethylbutylketone, and the like.

Examples of preferred lipophilic solvents are hydrocarbons, preferably those having less than 15 carbon atoms, in particular less than 10 carbon atoms which may contain halogen atoms or oxygen atoms. These compounds are obviously other than the alcohols or ketones. For example, such lipophilic solvents include hydrocarbons such as hexane, petroleum benzin, petroleum ether, ligroin, gasoline, benzene, toluene, xylene, biphenylethane and the like, ethers such as methyl ether, ethyl ether, isopropyl ether, ethyl-butyl ether, dioxane, and the like, halogenated hydrocarbons such as methyl chloride, chlorinated methane, chloroform, carbon tetrachloride, trichloroethane, trichloroethylene, chlorotoluene, dichlorobenzene, chloromethylethyl ether, dichloroethyl ether, chlorohydrin and the like.

It is to be understood that useful solvents are not limited to the specific examples recited above, and the selection of any special hydrophilic or lipophilic solvent is not overly critical.

The washing of the sheet with a mixed solvent, a deionized water, etc. can be accomplished by any appropriate means known to those skilled in the art, for example, by immersing the sheet into the washing liquid, or passing the sheet through the washing liquid, or spraying the washing liquid onto the sheet etc. If necessary, the washing liquid may be heated to an appropriate temperature. Further, the purification treatment may be carried out on the fibers before the sheet-making step.

The process of this invention will now be further illustrated in greater detail by the following non-limiting examples wherein all sheet weights are basis weights unless otherwise indicated.

EXAMPLE 1

36 continuous filaments spun from polypropylene (intrinsic viscosity 1.4) by the melt-spinning method at a rate of 4500 m per minute were introduced into an aspirator gun moving above a conveyor belt in direction transverse to the movement of the conveyor belt, and the filaments being drawn at a drawing ratio of 400 % through the aspirator gun were continuously accumulated on the conveyor belt in a looped state.

The web of continuous filaments thus obtained was a bulky web having a basis weight of 17 g/m$^2$, a width of 20 cm, and a thickness of 2 mm. In this case, the production rate of the web was 10 m per minute. The drawn continuous filaments had an average fineness of 2 denier, a birefringence of $3.0 \times 10^{-2}$ (The birefringence of the filaments was determined in glycerin by the retardation method using a polarizing microscope equipped with a Berek compensater) and a density of 0.91. The five layers of the resulting webs were piled and needled using No. 25 felting needles (100 needlings/m$^2$) to obtain a uniform sheet having a weights of 85.8 g/m$^2$, a thickness of 3 mm, and a low air-impermeability.

The resulting sheet was then continuously subjected to frinctional calendering using a universal calender (available from Uri Roll Co., Japan) comprising a heated steel roll (surface temperature: 150°C), and a paper roll comprising a plurality of laminated paper discs at a frictional ratio of 50 %, a nip-pressure of 150 Kg/cm, a calendering temperature of 150°C, and a calendering rate of 3 m/minute to obtain the polypropylene paper having the properties shown in Table 1 below. (The paper obtained is referred to as "Sample Paper - I".)

EXAMPLE 2

In the same manner as described in Example 1 except polypropylene having an intrinsic viscosity of 2.0 was used as a raw material and filaments thereof were formed with an extension of 500 % (draw ratio), a uniform sheet having a thickness of 33 mm was produced from the polypropylene filaments having a birefringence of $3.5 \times 10^{-2}$, a density of 0.920, and a fineness of 2 denier. The resulting sheet was then continuously subjected to frictional calendering using the same calender as was used in Example 1 at a frictional ratio of 70 %, a calendering temperature of 155°C, a nip-pressure of 220 Kg/cm, and a calendering rate of 3 m/minute to obtain the polypropylene paper having the properties shown in Table 1 below. (The paper obtained is referred to as "Sample Paper -II").

COMPARATIVE EXAMPLE 1

In the same manner as described in Example 1 except that a polypropylene having an intrinsic viscosity of 0.9 was used as a raw material and filaments thereof were formed with extension of 100 % (draw ratio), a sheet having a weight of 85.0 g/m$^2$ and a thickness of 5 mm was produced from the polypropylene filaments having a birefringence of $1.8 \times 10^{-2}$, a density of 0.92, and a fineness of 2 denier. The resulting sheet was then subjected to frictional calendering under the same conditions as in Example 1 to obtain a polypropylene paper having the properties shown in Table 1 below. (The paper obtained is referred to as "Sample Paper —III").

Table 1

| Sample No. of Polypropylene Paper | Thickness (μ) | Air-Imperme-*1 ability (G. sec/100cc) | Tensile Strength*2 (Kg/mm$^2$) | Dissipation*4 Factor at 80°C (%) | Oil Resistance | |
|---|---|---|---|---|---|---|
| | | | | | Test*5 Oil | Tensile Strength*3 after Heating in Oil (Kg/mm$^2$) |
| Sample Paper-I | 120 | 3000 | 4.5 | 0.05 | A Oil | 4.4 |
| | | | | | B Oil | 4.4 |
| | | | | | E Oil | 4.3 |
| | | | | | G Oil | 4.0 |

Table 1-continued

| Sample No. of Polypropylene Paper | Thickness (μ) | Air-Imperme-*1 ability (G. sec/100cc) | Tensile Strength*2 (Kg/mm²) | Dissipation*4 Factor at 80°C (%) | Oil Resistance | |
|---|---|---|---|---|---|---|
| | | | | | Test*5 Oil | Tensile Strength*3 after Heating in Oil (Kg/mm²) |
| Sample Paper-II | 120 | 3200 | 5.1 | 0.04 | I Oil | 5.1 |
| | | | | | E Oil | 5.1 |
| | | | | | C Oil | 5.1 |
| | | | | | D Oil | 5.1 |
| | | | | | F Oil | 5.1 |
| | | | | | H Oil | 5.1 |
| Sample Paper-III | 120 | 2800 | 4.2 | 0.04 | E Oil | 1.8 |

*1Tested according to JIS P8117 (hereinafter unless otherwise indicated air-impermeability was always determined according to this test).
*2Determined in accordance with ASTM D-828 in the direction of the machine (hereinafter unless otherwise indicated tensile strength was always determined according to this test).
*3A sample piece having a width of 15 mm and a length of 250 mm cut from the polypropylene papers was placed in a breaker filled with one of the test oils shown in Table 1, and then maintained at a temperature of 80°C for 100 days, and thereafter the tensile strength of each paper was determined at the ambient temperature (hereinafter unless otherwise indicated the oil resistance was determined according to this test).
*4Three pieces of the sample paper having a diameter of 100 mm cut from the propylene paper were placed between metal disk electrodes equipped with guard electrode as specified in JIS C-2111,19.1, dried in vacuo at 0.1 mmHg at 75°C for 10 hours, and then impregnated with a liquid paraffin which had been degassed having a viscosity of 13 cst at 37.8°C and a refractive index of $\eta_D^{20} = 1.461$. After impregnation, the impregnated sample was allowed to stand for 12 hours and was then adjusted to a temperature of 80°C. The dissipation factor was then determined using a high voltage Schering bridge at 3 KV and 60 Hz (hereinafter unless otherwise indicated the dissipation factor was always determined according to this test).
*5The composition and properties of the test oils are shown in Table 2 below.

Table 2

| Insulating Oil | Composition | Kinetic Viscosity at 37.8°C (cst) |
|---|---|---|
| A Oil | Polybutene*6 | 120 |
| B Oil | Polybutene*7 | 780 |
| C Oil | A mixture of 100 parts of polybutene (A oil) and 10 parts of dodecylbenzene*8 | 108 |
| D Oil | Liquid paraffin | 13 |
| E Oil | A mixture of 100 parts of liquid paraffin (D oil) and 15 parts of a heavy alkylate*9 | 21 |
| F Oil | Dodecylbenzene*8 | 7.10 |
| G Oil | A mineral oil having % CA 28*10 | 1.150 |
| H Oil | Methylphenylpolysiloxane*11 | 22 |
| I Oil | Trichloro Diphenyl*12 | 15 |

*6LV-50E available from Furukawa Chemical Industries Co., Ltd. having a bromine value of 39 as determined in accordance with ASTM D-1159.
*7HV-15E available from Furukawa Chemical Industires Co., Ltd. having a bromine value of 30 as determined in accordance with ASTM D-1159.
*8A hard type alkylbenzene mixed oil having an average molecular weight of 253 and a refractive index of $\eta_D^{20} = 1.4878$, available from Mitsubishi Petro-Chemical Co., Ltd.
*9An oil comprising 35% monoalkylbenzene and 65% dialkylbenzene, having a viscosity of 35.7 cst at 37.8°C, available from Mitsubishi Petro-Chemical Co., Ltd.
*10% CA was determined at 20°C in accordance with the n-d-M Method disclosed in Aspects of Constitution of Mineral Oils by K. Van Nes and H. A. Westen, Elsevier, New York (1951), page 356–361.
*11Phenyl content : 20 %, available from Shinetsu Kagaku Kogyo K.K.
*12Trade Name "Kanecrol 300" available from Kanegafuchi Chemical Industry Co., Ltd.

As is apparent from the results shown in Table 1, both Sample Paper — I and Sample Paper — II composed of a polypropylene fiber having a birefringence greater than $2.5 \times 10^{-2}$ retains its initial tensile strength even after immersing in various oils maintained at 80°C for 100 days, indicating that the papers have an excellent oil-resistance. On the contrary, Sample Paper — III composed of a polypropylene fiber having a birefringence less than $2.5 \times 10^{-2}$ swells to a small degree and displays a significant decrease in tensile strength after E oil immersion.

COMPARATIVE EXAMPLE 2

A polypropylene paper was produced in the same manner as described in Example 1 except that the sheet was subjected to frictional calendering at a temperature of 60°C. The resulting polypropylene paper was found to have an air-impermeability of 120 G sec/100 cc.

EXAMPLE 3

A polypropylene having a intrinsic viscosity of 2.0 was spun with an extension of 600% (draw ratio) by the melt-spinning method, and the drawn polypropylene fiber having a birefringence of $3.5 \times 10^{-2}$, a density of 0.92, and a fineness of 2 denier was cut into lengths of 5 mm. 85% by weight of the resulting short cut fibers and 15% by weight of a fibrous polyvinyl alcohol binder having a fineness of 1 denier and a fiber length of 4 mm (Trade Name : Fibribond No.241, available from Sansho Kabushiki Kaisha, Japan) were dispersed in water at a 2% fiber concentration, together with a nonionic surface active agent (Trade Name : Emulgen 905, available from Kao Soap Co., Ltd., Japan).

To the resulting dispersion there was added an aqueous solution of carboxymethylcellulose having an etherification value of 0.65% (the carboxymethylcellulose having a viscosity of from 150 to 250 cp in a 1aqueous solution at 20°C) at a level of 100 ppm. The wet sheet was formed from the dispersion at a rate of 150 m/minute using a cylinder machine. The surface temperature of the Yankee drier in the paper-making machine was maintained at a temperature of 100°C, which was sufficient to melt the fibrous polyvinyl alcohol binder.

The resulting sheet was then heat-treated at a temperature of 150°C for 1 minute without any tension applied thereto to yield a water-resistant paper with a weight of 110 g/m².

The paper thus obtained was immersed in boiling water for about 10 minutes and then washed with water to remove the polyvinyl alcohol, carboxymethylcellulose, surface active agent and other impurities. The paper was subsequently washed with deionized water to remove any ionic substances present followed by air-drying and subjected to a frictional calendering under the same conditions as were used in Example 1. The resulting polypropylene paper was found to have an air-impermeability of 6500 G sec/100 cc and a dissipation factor of 0.042% at 80°C in the unimpregnated dry state. The paper was further extracted with a mixed solvent of ethanol-benzene (1:1 by volume) to remove the spinning oil employed in fiber-spinning process giving a paper having an improved dissipation factor of 0.021% at 80°C.

EXAMPLE 4

Into a pressure-resistant tank equipped with a nozzle were charged methylene chloride and polypropylene (5.0 % decalin extractable content at 77°C, intrinsic viscosity 1.8, density 0.91). After heating, the value of the nozzle was opened to eject the solution contained in the tank by the action of the vapor pressure of methylene chloride to obtain a microfiber strand of polypropylene. The strand was then cut into 10 – 15 mm lengths, and then shredded into individual microfibers having an average diameter of 5 $\mu$ and an average length of 10 mm. Twenty percent by weight of the resulting polypropylene microfibers and eighty percent by weight of polypropylene fibers having a birefringence of $3.5 \times 10^{-2}$, a density of 0.92, a fineness of 2 deniers, and a length of 35mm were uniformly blended and placed onto a random webber having a stroke of 1000 mm to produce a non-woven web having a weight of 18 g/m$^2$ at a rate of 7 m per minute.

The five layers of the resulting webs were pressed under a pressure of 2 Kg/cm$^2$ (gauge pressure) at a temperature of 100°C for 5 seconds, and were needled at a rate of 100 needlings/m$^2$ using No. 25 felting needles to obtain an uniform sheet having a weight of 90 g/m$^2$, a thickness of 3 mm and good air-impermeability. This sheet was then subjected to a frictional calendering under the same conditions as were described in Example 2 to yield a polypropylene paper having the properties shown in Table 3 below. (The paper obtained is referred to as "Sample Paper - IV".)

COMPARATIVE EXAMPLE 3

A polypropylene paper was prepared in the same manner as described in Example 4 except that the microfibers were prepared from polypropylene having a decalin extractable content of 22% at 77°C, an intrinsic viscosity of 1.5 and a density of 0.90, and 35 percent by weight of these microfibers were blended to form the non-woven web. The properties of the resulting paper are shown in Table 3 below (The paper obtained is referred to as "Sample Pater — V".)

EXAMPLE 5

A filament strand was obtained by the melt-spinning method from a polypropylene having an intrinsic viscosity of 2.0, a decalin, extractable content of 5% at 77°C and a density of 0.91. The filament strand was then cut into lengths of 5 – 6 mm. The strands thus cut were dispersed in water and were then separated into individual microfibers having an average diameter of 5 $\mu$ and an average cut length of 2.5 mm, using a disk refiner available from kumagaya Riki Industries Co., Ltd., Japan.

25 percent by weight of the above microfibers, 75 percent by weight of polypropylene fibers having a birefringence of $3.5 \times 10^{-2}$, a density of 0.92, a fineness of 2 denier and a cut length of 5 mm, and 15 parts by weight (based on the total weight of both fibers) of a polyvinyl alcohol binder (Trade Name : Fibribond No. 241, available from Sansho Kabushiki Kaisha, Japan) were dispersed in water containing a small amount of a nonionic surface active agent (Trade Name : Emulgen 905, available from Kao Soap Co., Ltd., Japan) to yield a 2% fiber concentration. A sheet having a weight of 80/m$^2$ was made from the resulting dispersion in the same manner as described in Example 3. This sheet was subsequently subjected to a heat treatment and a purification treatment in the same manner as described in Example 3, and thereafter calendered at a temperature of 155°C, a friction ratio of 50%, a nip-pressure of 200 Kg/cm and a calendering rate of 2m/minute using the same calender as was used in Example 1. The polypropylene paper was thus obtained was found to have the properties as shown in Table 3. (This paper is referred to as "Sample Paper —VI".) The results shown in Table 3 indicate that Sample Papers —IV and —VI exhibit higher oil-resistance, as compared to the Sample Paper —V.

Table 3

| | Sample Paper-IV | Sample Paper-V | Sample Paper-VI |
|---|---|---|---|
| Thickness($\mu$) | 120 | 120 | 120 |
| Air-Impermeability(G.sec/100cc) | 8000 | 7800 | 1200 |
| Tensile Strength(Kg/mm$^2$) | 6.0 | 4.8 | 6.2 |
| Oil-Resistance (Tensile Strength after Heating in I Oil immersion, Kg/mm$^2$) | 5.7 | 3.5 | 5.9 |
| Dissipation Factor at 80°C (%) | 0.04 | 0.04 | 0.04 |

EXAMPLE 6

A side by side bicomponent fiber consisting of 25% polyethylene having a density of 0.962 g/cc (Trade Name : Hizex 1500 J, available from Mitsui Petro-Chemical Co., Ltd.) and 75% polypropylene having intrinsic viscosity of 2.0 and a density of 0.91 g/cc (Trade Name : Polypropylene No. 2000, available from Mitsubishi Petro-Chemical Co., Ltd.) was drawn at a draw ratio of 400% at a temperature of 100°C and heated under steam pressure of 2.0 Kg/cm$^2$ in an extended state to yield a 3 denier fiber. The polypropylene portion of the bicomponent fiber thus obtained was found to have a birefringence of $2.9 \times 10^{-2}$, determined after removing the polyethylene portion. The side by side bicomponent fiber treated as above was then cut into lengths of 6 mm using a rotary cutter.

60 percent by weight of a polypropylene fiber having a fineness of 2 denier, a birefringence of $3.0 \times 10^{-2}$, a density of 0.92 and a length of 6 mm (Trade Name : Mitsubishi Pylene), 40 percent by weight of the side by side bicomponent fiber described above, and 15 parts by weight (based on the total amount of both fibers) of a fibrours polyvinyl alcohol binder (Trade Name : Fibribond No. 243) were dispersed in water containing a samll amount of a nonionic surface active agent to obtain a fiber dispersion with a 1.5% fiber concentration.

Carboxymethylcellulose (0.65% etherification value, a viscosity : 150 – 200 cps in a 1% aqueous solution at 20°C) was then added to the above fiber dispersion at a concentration of 100 ppm, and a sheet having a weight of 60 g/m$^2$ was made by using a cylinder machine.

This sheet was subsequently subjected to heat-treatment at a temperature of 140°C without any extension to obtain a sheet having a weight of 110 g/m$^2$ and displaying excellent mechanical strength upon water immersion.

This sheet was washed in boiling water for about 10 minutes in order to remove the polyvinyl alcohol, the carboxymethylcellulose, the surface active agent and washed again with deionized water to remove any ionic substances present.

After this sheet was dried, it was then subjected to frictional calendering at a temperature of 105°C, a nip-pressure of 132 Kg/cm and a frictional ratio of 18% to obtain a paper having an air-impermeability of 2000 G sec/100 cc, a dissipation factor of 0.058% at 80°C (impregnated with liquid paraffin) and a tensile strength of 5.9 Kg/mm$^2$. The resulting paer was also found to have a tensile strength of 5.0 Kg/mm$^2$ after it was subjected to the oil-resistance test using A Oil shown in Table 2. The polypropylene paper extracted with a mixed solvent of ethanolbenzene (1:1 by volume) to remove any remaining spinning oil to give the paper having an improved dissipation factor of 0.030%.

EXAMPLE 7

75 percent by weight of the polypropylene fiber having a fineness of 2 denier and a cut length of 5 mm prepared in Example 3, 25 percent by weight of polyethylene fiber having a fineness of 2 denier, a length of 5 mm and a density of 0.962 (Trade Name : Hizex 1500 J, available from Mitsui Petrochemical Industries, Ltd.), and 15 parts by weight (based on the total amount of both fibers) of a fibrous polyvinyl alcohol binder having a fineness of 1 denier and a length of 4 mm (Trade Name : Fibribond No. 241, available from Sansho Kabushiki Kaisha) were dispersed in water containing a small amount of a nonionic surface active agent (Emulgen 905, available from Kao Soap Co., Ltd.) to obtain a fiber dispersion having a fiber concentration of 2 %. The dispersion was then subjected to a sheet-making process in the same manner as was used in Example 3 except for using three different sheet-making rates to obtain three types of sheet having a weight of 16 g/m$^2$, 40 g/m$^2$ and 70 g/m$^2$, respectively. The sheets thus obtained were then heat-treated at a temperature of 150°C without any extension to form sheets having a weight of 23 g/m$^2$, 52 g/m$^2$ and 86 g/m$^2$, respectively. The sheets were then immersed in boiling water in the same manner as described in Example 3 to remove any water-soluble substances to yield sheets having a weight of 20 g/m$^2$, 47 g/m$^2$ and 78 g/m$^2$, respectively. These sheets were then subjected to frictional calendering at a temperature of 150°C, a nip-pressure of 200 Kg/cm, a frictional ratio of 70% and a calendering rate of 2 m/min. to yield papers having a high air-impermeability as shown in Table 4 where the air-impermeability of the paper obtained is shown with the corresponding weight of the sheet treated.

Table 4

| Weight of Sheets before Calendering (g/m$^2$) | Air-Impermeability of Papers finally obtained (Gurley.sec/100 cc) |
|---|---|
| 20 | 3200 |
| 47 | 7800 |
| 78 | 7950 |

EXAMPLE 8

A sheet was made using a small paper-making machine (30 cm in width) from a polypropylene fiber having a fineness of 2 denier, a length of 2 mm and a birefringence of $3.0 \times 10^{-2}$ was dispersed in tetralin. The resulting sheet was heated at a temperature of 110°C under a pressure of 100 Kg/cm$^2$ for 2 minutes using a heat-press. The heat-pressed sheet was then dried at a temperature of 110°C for several minutes in order to achieve the complete removal of solvent remaining in the sheet. The sheet was washed with deionized water, subsequently extracted with a mixed solvent of ethanol-benzene (1:1 by volume), and then subjected to frictional calendering at a temperature of 160°C, a frictional ratio of 70%, a nip-pressure of 200 Kg/cm and a calendering rate of 1 m/min. The resulting paper was found to have an air-impermeability of 6000 G.sec/100cc, a weight of 100 g/m$^2$, a thickness of 110 $\mu$ and a tensile strength of 5.0 Kg/mm$^2$. The tensile strength of the paper after A Oil immersion was found to be 3.9 Kg/mm$^2$.

EXAMPLE 9

A paper was prepared in the same manner as described in Example 8 except that, in the formation of the preceding sheet 80 percent by weight of the polypropylene fiber as described in Example 8 was replaced by polypropylene fiber which had been obtained by heat-treating the same polypropylene at a temperature of 150°C for 5 minutes under extension and then cutting the polypropylene into pieces 10 mm in length. The resulting paper was found to have an air-impermeability of 5800 G.sec/100cc, a thickness of 110 $\mu$ and a tensile strength of 5.4 Kg/mm$^2$. The tensile strength of the paper after A Oil immersion was found to be 5.0 Kg/mm$^2$.

While the invention has been described in detail and with reference to specific embodiments thereof, it will be apparent to one skilled in the art that various changes and modifications can be made therein without departing from the spirit and scope thereof.

We claim:

1. A process for producing an insulating paper having high air-impermeability and high oil resistance suitable for use in an oil-filled electrical device which comprises forming a sheet of polyolefin fibers containing at least 70% by weight of polypropylene fibers having a denier of at least 0.5 and a birefringence of at least $2.5 \times 10^{-2}$, and frictionally calendering said sheet in the dry state at a frictional ratio of at least 15% and at a temperature in the range from 90°C to 160°C.

2. A process according to claim 1, wherein said frictional ratio is at least 20% and said temperature ranges from 115° to 160°C.

3. A process according to claim 2, wherein said sheet comprises a mixture of: (1) 30% by weight, or less, of polypropylene microfibers having a diameter less than 10 $\mu$ prepared from a polypropylene whose extractable contents in decalin at 77°C is less than 15% by weight; and (2) at least 70% by weight of polypropylene fibers having a denier of at least 0.5 and a birefringence of at least $2.5 \times 10^{-2}$.

4. A process according to claim 1, said sheet of polyolefin comprises polypropylene-polyethylene bicomponent fibers containing at least 70% by weight of a polypropylene fiber portion having a denier of at least 0.5 and a birefringence of at least $2.5 \times 10^{-2}$.

5. A process according to claim 1, wherein said sheet of polyolefin fibers comprises a mixture of: (1) polypropylenepolyethylene bicomponent fibers containing a polypropylene fiber portion having a denier of at least 0.5 and a birefringence of at least $2.5 \times 10^{-2}$; and (2) polypropylene fibers having a denier of at least 0.5 and a birefringence of at least $2.5 \times 10^{-2}$, the total amount of said polypropylene fibers portion being at least 70% by weight of the total weight of said sheet.

6. A process according to claim 1, wherein said sheet of polyolefin fibers comprises a mixture of: (1) 30% by weight, or less, of polyethylene fibers having a denier of at least 0.5; and (2) at least 70% by weight of polypropylene fibers having a denier of at least 0.5 and a birefringence of at least $2.5 \times 10^{-2}$.

7. A process according to claim 4, wherein said polyethylene has a density in the range of from 0.955 to 0.97.

8. A process according to claim 5, wherein said polyethylene has a density in the range of from 0.955 to 0.97.

9. A process according to claim 6, wherein said polyethylene has a density in the range of from 0.955 to 0.97.

10. A process according to claim 2, wherein said frictional ratio is at least 25%.

11. A process according to claim 2, wherein said polypropylene fiber has a birefringence of at least $3.0 \times 10^{-2}$.

12. A process according to claim 11, wherein said polypropylene fibers are formed from a polypropylene having a density of at least 0.89 and an intrinsic viscosity in the range of from about 1.0 to about 3.0.

13. A process according to claim 2, wherein said sheet of polyolefin fibers has a basis weight in the range of from 20 to 400 g/m$^2$ before being subjected to said frictional calendering.

14. A process according to claim 2, wherein said sheet of polyolefin fibers is washed with a solvent before and/or after being subjected to said frictional calendering.

15. A process according to claim 14, wherein said solvent is water at a temperature of at least 40°C.

16. A process according to claim 14, wherein said solvent is a hydrophilic solvent.

17. A process according to claim 14, wherein said solvent is a lipophilic solvent.

18. A process according to claim 14, wherein said solvent is a mixture of a hydrophilic solvent and a lipophilic solvent.

19. A process according to claim 14, wherein said washing is conducted first with water, then with deionized water and finally with a mixture of a hydrophilic solvent and a lipophilic solvent.

20. The process of claim 4 wherein the polyethylene comprises at least about 5% by weight of the balance of the bicomponent fiber.

21. The process of claim 20 wherein the polyethylene comprises from 10 to 20% by weight of the balance of the bicomponent fiber.

22. The process of claim 6 wherein the sheet comprises at least about 5% by weight polyethylene fibers.

23. The process of claim 22 wherein the sheet comprises from 10 to 20% by weight polyethylene fibers.

24. A process according to claim 1 wherein said polypropylene is formed into a sheet by a dry processing.

25. A process according to claim 1 wherein said polypropylene is formed into a sheet by a wet processing.

26. A process according to claim 25, wherein said polypropylene fibers having a denier of at least 0.5 and a birefringence of at least $2.5 \times 10^{-2}$ have a cut length of 0.5 to 20 mm, and said insulating paper exhibits a uniform air-impermeability.

27. A process according to claim 25 wherein a binder is used to form said sheet, said binder being removed prior to frictional calendering.

28. A process according to claim 25 wherein an organic solvent is used to form said sheet, said organic solvent being removed prior to frictional calendering.

29. A process according to claim 1, wherein said sheet consists essentially of polyolefins, at least 70% by weight of which are said polypropylene fibers having a denier of at least 0.5 and a birefringence of at least $2.5 \times 10^{-2}$.

* * * * *